US010779702B2

(12) United States Patent
Li et al.

(10) Patent No.: US 10,779,702 B2
(45) Date of Patent: Sep. 22, 2020

(54) SPRAYING ASSEMBLY FOR DISH WASHING MACHINE AND DISH WASHING MACHINE HAVING SAME

(71) Applicants: FOSHAN SHUNDE MIDEA WASHING APPLIANCES MFG. CO., LTD., Foshan (CN); MIDEA GROUP CO., LTD., Foshan (CN)

(72) Inventors: Mingfeng Li, Foshan (CN); Feng Gao, Foshan (CN)

(73) Assignees: FOSHAN SHUNDE MIDEA WASHING APPLIANCES MFG. CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 205 days.

(21) Appl. No.: 15/993,938

(22) Filed: May 31, 2018

(65) Prior Publication Data

US 2018/0271348 A1 Sep. 27, 2018

Related U.S. Application Data

(63) Continuation of application No. PCT/CN2015/096165, filed on Dec. 1, 2015.

(51) Int. Cl.
*A47L 15/22* (2006.01)

(52) U.S. Cl.
CPC ..... *A47L 15/22* (2013.01)

(58) Field of Classification Search
CPC ..... A47L 15/22
USPC ..... 134/172
See application file for complete search history.

(56) References Cited

FOREIGN PATENT DOCUMENTS

| | | | |
|---|---|---|---|
| CN | 2282855 | Y | 6/1998 |
| CN | 203789884 | U | 8/2014 |
| CN | 104545744 | A | 4/2015 |
| CN | 104720716 | A | 6/2015 |
| CN | 104739346 | A | 7/2015 |
| CN | 105054882 | A | 11/2015 |
| EP | 1882435 | A1 | 1/2008 |

(Continued)

OTHER PUBLICATIONS

CN104545744A—Machine translation (Year: 2015).*

(Continued)

*Primary Examiner* — Tinsae B Ayalew
(74) *Attorney, Agent, or Firm* — Morgan, Lewis & Bockius LLP

(57) ABSTRACT

A spraying assembly for a dish washing machine includes: a bottom shell, a spraying seat, a sprayer and an actuator. A water storage chamber is formed in the bottom shell, which is provided with a water inlet in communication with the water storage chamber. The spraying seat is rotatably disposed on the bottom shell and provided with a water input passage in communication with the water storage chamber. The sprayer is provided with at least one spraying arm and rotatably disposed on the spraying seat and a rotation center of the sprayer is eccentrically arranged with respect to a rotation center of the spraying seat. The sprayer is provided with a plurality of spraying orifices, each being in communication with the water input passage. The actuator is connected to the sprayer and the spraying seat respectively to drive the sprayer and the spraying seat to rotate around their respective rotation centers.

15 Claims, 9 Drawing Sheets

(56) References Cited

FOREIGN PATENT DOCUMENTS

KR 1019930006002 B 7/1993

OTHER PUBLICATIONS

Foshan Shunde Midea Washing Appliances Mfg. Co. Ltd., Office Action, CA3006690, Feb. 14, 2019, 4 pgs.
Foshan Shunde Midea Washing Appliances Mfg. Co. Ltd., Communication Pursuant to Rules 70(2) and 70a(2), EP15909499.4, Jan. 24, 2019, 5 pgs.
Midea, International Search Report and Written Opinion, PCT/CN2015/096165, dated Sep. 5, 2016, 18 pgs.

* cited by examiner

SPRAYING ASSEMBLY FOR DISH WASHING MACHINE AND DISH WASHING MACHINE HAVING SAME

PRIORITY CLAIM AND RELATED APPLICATION

This application is a continuation of PCT Patent Application No. PCT/CN2015/096165, entitled "SPRAYING ASSEMBLY FOR DISH WASHING MACHINE AND DISH WASHING MACHINE HAVING SAME" filed on Dec. 1, 2015, which is hereby incorporated by reference in its entirety.

TECHNICAL FIELD

The present disclosure relates to a technical field of dish washing machines, and more particularly to a spraying assembly for a dish washing machine and a dish washing machine having the same.

BACKGROUND

With increasing improvements in people's living standards, requirements for intelligent household appliances are increasingly higher. For example, a household dish washing machine can replace manual work to wash tableware. The dish washing machine uses a plurality of spraying arms which rotate while jet-washing the tableware, in conjunction with actions of water such as reflection, splashing and flowing, and completes a washing coverage of the tableware in the dish washing machine. However, since an inner tub of the dish washing machine generally is near quadrate, a common rotary spraying arm has a round spraying area and hence it is difficult to reach front and rear regions in the dish washing machine, such that a washing dead zone tends to be caused, thereby causing insufficient washing at the front and rear regions in the dish washing machine, and greatly reducing overall washing and cleaning effects.

SUMMARY

Embodiments of the present disclosure seek to solve at least one of the problems existing in the related art to at least some extent. For that reason, a spraying assembly for a dish washing machine is provided by the present disclosure, and the spraying assembly of the dish washing machine has a simple structure, a wide washing coverage and a good washing effect.

A dish washing machine having the above-mentioned spraying assembly is further provided by the present disclosure.

The spraying assembly for the dish washing machine according to embodiments of a first aspect of the present disclosure includes: a bottom shell, the bottom shell defining a water storage chamber therein, the bottom shell having a water inlet in communication with the water storage chamber; a spraying seat, the spraying seat being rotatably disposed on the bottom shell, the spraying seat having a water input passage in communication with the water storage chamber; a sprayer, the sprayer having at least one spraying arm, the sprayer being rotatably disposed on the spraying seat and a rotation center of the sprayer being eccentrically arranged with respect to a rotation center of the spraying seat, the sprayer having a plurality of spraying orifices spaced apart, each spraying orifice being in communication with the water input passage; and an actuator, the actuator being connected to the sprayer and the spraying seat respectively, so as to drive the sprayer and the spraying seat to rotate around their respective rotation centers.

In the spraying assembly for the dish washing machine according to embodiments of the present disclosure, the sprayer is rotatably disposed in an eccentric position of the spraying seat rotatable with respect to the bottom shell, such that each spraying orifice of the sprayer has an epicycloid motion track, e.g., a spray-wash area is substantially quadrate, thereby enlarging a washing area of the spraying assembly, and solving a problem that the dish washing machine in the related art cannot wash a dead corner of an inner tub. The spraying assembly for the dish washing machine has a simple structure, a wide washing coverage, a good washing effect and a high user experience.

In addition, the spraying assembly for the dish washing machine according to embodiments of the present disclosure can further have the following technical features.

According to an embodiment of the present disclosure, the spraying assembly for the dish washing machine further includes: a driving transmission member, the driving transmission member being connected to the actuator and the sprayer, the driving transmission member being driven by the actuator to drive the sprayer to rotate; and a driven transmission member, the driven transmission member being connected to the driving transmission member and the spraying seat, the driven transmission member being driven by the driving transmission member to drive the spraying seat to rotate.

According to an embodiment of the present disclosure, the driving transmission member includes a first sun gear and a drive shaft, a first end of the drive shaft is connected to the actuator, the first sun gear is connected to a second end of the drive shaft, the first sun gear is coaxial with the drive shaft and is driven by the drive shaft, and the sprayer is provided with a planetary gear engaged with the first sun gear.

According to an embodiment of the present disclosure, a gear ratio of the first sun gear to the planetary gear is 1:3.

According to an embodiment of the present disclosure, the gear ratio of the first sun gear to the planetary gear is 1:5.

According to an embodiment of the present disclosure, the driven transmission member is configured as a first gear disposed on the bottom shell, the first end of the drive shaft is provided with a second sun gear engaged with the first gear, the spraying seat is provided with a second gear engaged with the first gear, and the second sun gear cooperates with the first gear and the second gear to drive the spraying seat to rotate.

According to an embodiment of the present disclosure, the spraying seat has a mounting portion penetrating the bottom shell and extending downwards, the mounting portion is configured as a hollow column coaxial with the drive shaft, an upper end of the drive shaft passes through the mounting portion to be connected to the first sun gear, a lower end of the drive shaft is provided with the second sun gear, the first gear is disposed at a bottom portion of the bottom shell, and a lower end of the mounting portion is provided with the second gear.

According to an embodiment of the present disclosure, the upper end of the drive shaft is provided with a plurality of grooves spaced apart, and an inner ring of the first sun gear is provided with a plurality of bulges correspondingly fitted with the grooves.

According to an embodiment of the present disclosure, the end of the drive shaft, which is fitted with the first sun gear, is configured as a spline shaft, and the spline shaft is snapped with the first sun gear.

According to an embodiment of the present disclosure, the spraying seat is a rotary body, and a central axis of the spraying seat coincides with central axes of the bottom shell and the drive shaft.

According to an embodiment of the present disclosure, the spraying seat is provided with a mounting column eccentrically arranged with respect to the rotation center of the spraying seat, the mounting column defines the water input passage therein, and the sprayer is fitted over the mounting column and is rotatable with respect to the mounting column.

According to an embodiment of the present disclosure, the mounting column is provided with a plurality of locking tongues spaced apart, and an inner wall of the sprayer is provided with a mounting groove fitted with the locking tongues.

According to an embodiment of the present disclosure, the spraying assembly for the dish washing machine further includes a pressing plate, the pressing plate is provided on the bottom shell and connected to the bottom shell, and at least a part of the pressing plate is pressed on the spraying seat.

According to an embodiment of the present disclosure, the second sun gear is integrally formed with the drive shaft, the planetary gear is integrally formed with the sprayer, and the second gear is integrally formed with the spraying seat.

The dish washing machine according to embodiments of a second aspect of the present disclosure includes the spraying assembly for the dish washing machine according to the above-mentioned embodiments.

Additional aspects and advantages of embodiments of present disclosure will be given in part in the following descriptions, become apparent in part from the following descriptions, or be learned from the practice of the embodiments of the present disclosure.

Figure 1:
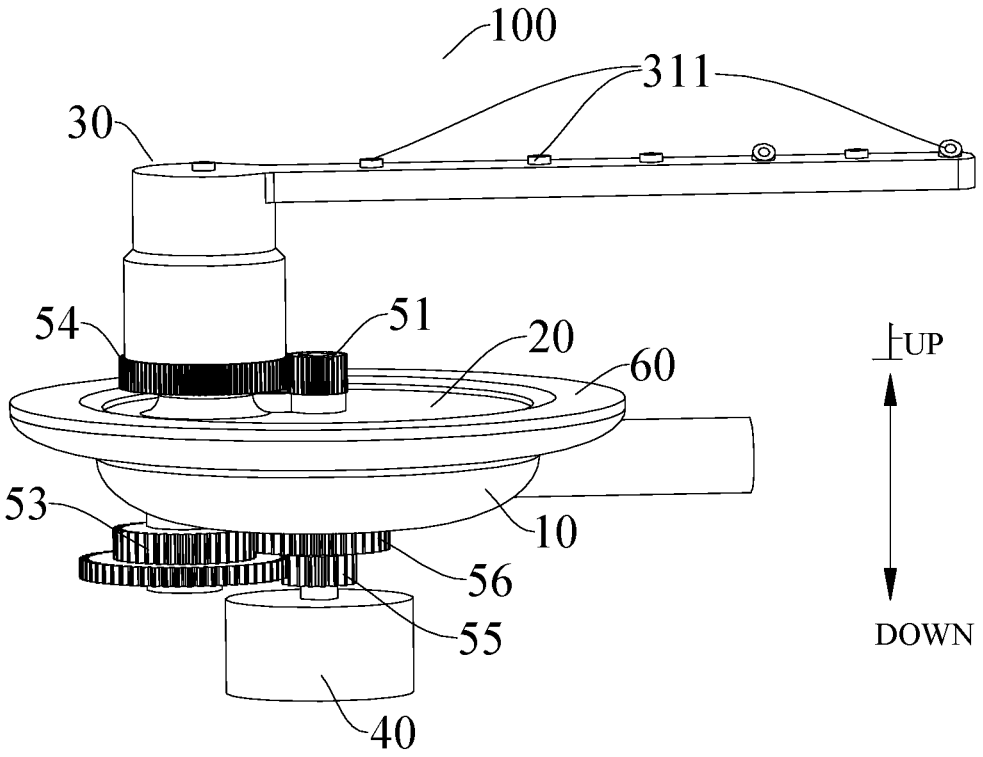
FIG. 1 is a perspective view of a spraying assembly for a dish washing machine according to embodiments of the present disclosure.

REFERENCE NUMERALS spraying assembly 100;

bottom shell 10; water storage chamber 11; water inlet 12; fixing shaft 13;

spraying seat 20; water input passage 21; mounting portion 22; mounting column 23; locking tongue 231;

sprayer 30; first spraying arm 301*c*; second spraying arm 302*c*; third spraying arm 303*c*; spraying arm 31; spraying orifice 311; mounting groove 32; sleeve 33;

actuator 40;

first sun gear 51; bulge 511; drive shaft 52; groove 521; first gear 53; planetary gear 54; second sun gear 55; second gear 56;

pressing plate 60.

DETAILED DESCRIPTION

Embodiments of the present disclosure will be described in detail in the following, and examples of the embodiments are illustrated in the drawings. The embodiments described herein with reference to drawings are explanatory and used to generally understand the present disclosure. The embodiments shall not be construed to limit the present disclosure.

A spraying assembly 100 for a dish washing machine according to embodiments of a first aspect of the present disclosure will be described in detail with reference to FIGS. 1-8.

Figure 2:
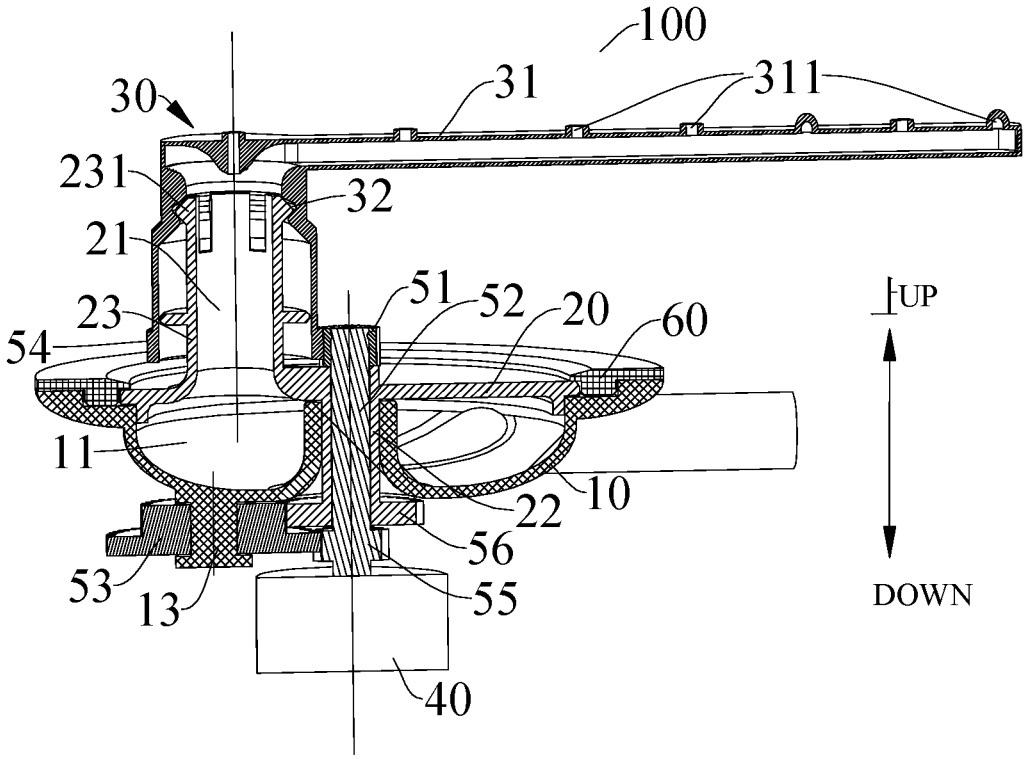
FIG. 2 is a sectional view of a spraying assembly for a dish washing machine according to embodiments of the present disclosure.
Figure 3:
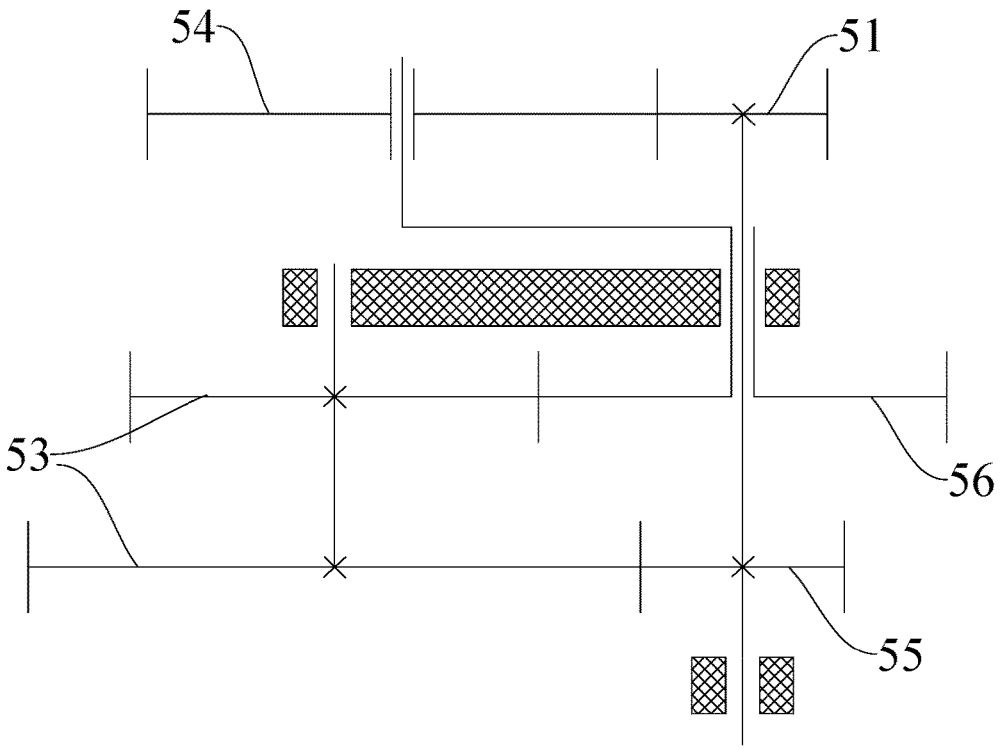
FIG. 3 is a simplified diagram of a spraying assembly for a dish washing machine according to embodiments of the present disclosure.

As illustrated in FIGS. 1 and 2, the spraying assembly 100 for the dish washing machine according to embodiments of the present disclosure includes a bottom shell 10, a spraying seat 20, a sprayer 30 and an actuator 40. Specifically, the bottom shell 10 defines a water storage chamber 11 therein. The bottom shell 10 has a water inlet 12 in communication with the water storage chamber 11. The spraying seat 20 is rotatably disposed on the bottom shell 10. The spraying seat 20 has a water input passage 21 in communication with the water storage chamber 11. The sprayer 30 includes at least one spraying arm 31. The sprayer 30 is rotatably provided to spraying seat 20 and a rotation center of the sprayer 30 is eccentrically arranged with respect to a rotation center of the spraying seat 20. The sprayer 30 has a plurality of spraying orifices 311 spaced apart, and each spraying orifice 311 is in communication with the water input passage 21. The actuator 40 is connected to the sprayer 30 and the spraying seat 20 respectively, so as to drive the sprayer 30 and the spraying seat 20 to rotate around their respective rotation centers.

That is to say, the spraying assembly 100 for the dish washing machine is mainly composed of the bottom shell 10, the spraying seat 20, the sprayer 30 and the actuator 40. The water storage chamber 11 having an opening upper end is defined in the bottom shell 10. A side wall or a bottom wall of the bottom shell 10 is provided with the water inlet 12 in communication with the water storage chamber 11, thus making it convenient for a system to inject washing water into the water storage chamber 11. The spraying seat 20 is disposed on the bottom shell 10 to close an opening upper end of the bottom shell 10, and the spraying seat 20 is rotatable with respect to the bottom shell 10. The spraying seat 20 has the water input passage 21 extending in a vertical direction (an up and down direction as illustrated in FIG. 2). The water input passage 21 is in communication with the water storage chamber 11. Advantageously, an inner wall of the bottom shell 10 is provided with the water inlet 12, and the washing water enters the water storage chamber 11 in a substantially tangential direction, then flows along an annular flow channel in the water storage chamber 11 to fill the whole water storage chamber 11, finally flows out of the water input passage 21 in the spraying seat 20, and flows to the respective spraying arms 31.

Furthermore, the actuator 40 is disposed below the bottom shell 10 and is connected to the spraying seat 20, so as to drive the spraying seat 20 to rotate. The sprayer 30 is disposed in an eccentric position of the spraying seat 20 and is rotatable with respect to the spraying seat 20. The sprayer 30 has at least one spraying arm 31. Each spraying arm 31 is provided with the plurality of spraying orifices 311 spaced apart in a length direction of the spraying arm 31. Each spraying orifice 311 is in communication with the water input passage 21.

During the operations of the spraying assembly 100 for the dish washing machine, the actuator 40 drives the spraying seat 20 to rotate around a central axis of the spraying seat 20. In this process, since the sprayer 30 is disposed in the eccentric position of the spraying seat 20, the sprayer 30 has a circular motion with respect to the spraying seat 20, and also has a motion with a changing rotation center in relative to the bottom shell 10. The washing water enters the water storage chamber 11 through the water inlet 12 of the bottom shell 10, then flows to each spraying arm 31 through the water input passage 21, and jets out of the plurality of spraying orifices 311, thus reaching the objective of dish washing, and also achieving a wide washing coverage.

Thus, in the spraying assembly 100 for the dish washing machine according to embodiments of the present disclosure, the sprayer 30 is rotatably disposed in the eccentric position of the spraying seat 20 which is rotatable with respect to the bottom shell 10, such that each spraying orifice 311 of the sprayer 30 has an epicycloid motion track, e.g., a spray-wash area is substantially quadrate, thereby enlarging the washing area of the spraying assembly 100, and hence solving the problem that the dish washing machine in the related art cannot wash a dead corner of an inner tub. The spraying assembly 100 for the dish washing machine has a simple structure, a wide washing coverage, a good washing effect and a high user experience.

According to an embodiment of the present disclosure, the spraying assembly 100 for the dish washing machine further includes a driving transmission member and a driven transmission member. Specifically, the driving transmission member is connected to the actuator 40 and the sprayer 30, the driving transmission member is driven by the actuator 40 and drives the sprayer 30 to rotate, the driven transmission member is connected to the driving transmission member and the spraying seat 20, and the driven transmission member is driven by the driving transmission member and drives the spraying seat 20 to rotate.

In other words, the spraying assembly 100 for the dish washing machine is mainly composed of the bottom shell 10, the spraying seat 20, the sprayer 30, the driving transmission member, the driven transmission member and the actuator 40. The driving transmission member is connected to the actuator 40 and the sprayer 30 respectively. The driven transmission member is connected to the spraying seat 20, and the driving transmission member is fitted with the driven transmission member. When the spraying assembly 100 for the dish washing machine starts operating, the actuator 40 drives the driving transmission member to move, such that the driving transmission member drives the sprayer 30 to rotate with respect to the spraying seat 20, and the driving transmission member also drives the driven transmission member to move, so as to drive the spraying seat 20 to rotate with respect to the bottom shell 10. Thus, by arranging the driving transmission member and the driven transmission member to the spraying seat 20 and the bottom shell 10 respectively, a washing rotation speed required by a system of the dish washing machine is satisfied and transmissions of motion and power are facilitated.

Optionally, according to an embodiment of the present disclosure, the driving transmission member includes a first sun gear 51 and a drive shaft 52. A first end of the drive shaft 52 is connected to the actuator 40, and the first sun gear 51 is connected to a second end of the drive shaft 52. The first sun gear 51 is coaxial with the drive shaft 52 and is driven by the drive shaft 52. The sprayer 30 is provided with a planetary gear 54 engaged with the first sun gear 51.

Specifically, as illustrated in FIG. 2, the driving transmission member is mainly composed of the first sun gear 51 and the drive shaft 52. The drive shaft 52 extends in the vertical direction (the up and down direction illustrated in FIG. 2), and the drive shaft 52 is mounted to the spraying seat 20 and is rotatable with respect to the spraying seat 20. The first end (a lower end as illustrated in FIG. 2) of the drive shaft 52 is connected to the actuator 40, and the second end (an upper end as illustrated in FIG. 2) of the drive shaft 52 is connected to the first sun gear 51. A lower end of the sprayer 30 is provided with the planetary gear 54, and the planetary gear 54 is engaged with the first sun gear 51.

When the actuator 40 is started, the actuator 40 drives the drive shaft 52 to rotate around a central axis of the drive shaft 52, and the upper end of the drive shaft 52 drives the first sun gear 51 to rotate around the central axis of the drive shaft 52, such that the spraying seat 20 drives the sprayer 30 to rotate around the central axis of the drive shaft 52 (a revolution of the sprayer 30). In the meantime, the first sun gear 51 is engaged with the planetary gear 54, such that the sprayer 30 rotates around a central axis of the planetary gear 54 (a rotation of the sprayer 30). The lower end of the drive shaft 52 is fitted with the driven transmission member, so as to drive the spraying seat 20 to rotate around the central axis of the drive shaft 52. Since the planetary gear 54 is located in the eccentric position of the spraying seat 20, when the spraying assembly 100 for the dish washing machine starts operating, the sprayer 30 rotates with respect to the spraying seat 20, and the spraying seat 20 rotates with respect to the bottom shell 10.

In some specific embodiments of the present disclosure, a gear ratio of the first sun gear 51 to the planetary gear 54 is 1:3. Since the first sun gear 51 is externally engaged with the planetary gear 54, the rotation and the revolution of the planetary gear 54 have the same direction. Optionally, the gear ratio of the first sun gear 51 to the planetary gear 54 is 1:3. For example, the first sun gear 51 has 30 teeth, and the planetary gear 54 has 90 teeth. Thus, a ratio of a pitch radius R1 of the first sun gear 51 to a pitch radius R2 of the planetary gear 54 is 1:3 as well, and a radius R3 of a revolution trajectory of the planetary gear 54 is equal to a sum of R1 and R2.

Furthermore, due to the gear ratio and the external engagement between the first sun gear 51 and the planetary gear 54, ends of the respective spraying arms 31 present a prolate epicycloid motion track, thus covering a rectangle area better. Moreover, an angle of a phase difference between motion tracks of two spraying arms 31 is equal to 3/2 times of an angle of a phase difference between the two spraying arms 31.

For a single spraying arm 31, each spraying orifice 311 of the single spraying arm 31 has a characteristic epicycloid motion track. For the relatively outer spraying orifice 311, a distance from the spraying orifice 311 to a center of the planetary gear 54 is larger than four times of the pitch radius R2 of the planetary gear 54, and the motion track of such spraying orifice 311 is a prolate epicycloid. The curve does not cross itself, front and rear parts of the curve are curved outwards, and left and right parts of the curve are slightly curved inwards. With the position of the spraying orifice 311 moving inwards, the inwards curved portion of the prolate epicycloid motion track gradually gets obvious, a radius of a transition rounded corner is gradually reduced, and four corners gradually become sharp. When the distance from the spraying orifice 311 to the center of the planetary gear 54 is equal to four times of the pitch radius R2 of the planetary gear 54, the transition rounded corner at the inwards curved portion is just disappeared, the overall prolate epicycloid motion track of the spraying orifice 311 is a kidney-shaped curve with the front and rear parts thereof being curved outwards. Then, for the relatively inner spraying orifice 311, the distance from such spraying orifice 311 to the center of the planetary gear 54 is less than four times of the pitch radius R2 of the planetary gear 54, the inwards curved portion of the prolate epicycloid motion track has a crossed shape. Finally, for the spraying orifice 311 which is located at the center of the planetary gear 54, the motion track of such spraying orifice 311 is a revolution trajectory, i.e., a circle of radius R3.

Thus, the gear ratio of the first sun gear 51 to the planetary gear 54 is set as 1:3, such that each spraying orifice 311 of the sprayer 30 has the epicycloid motion track, e.g., the spray-wash area is substantially rectangle, thereby enlarging the washing area of the spraying assembly 100, and hence solving the problem that the dish washing machine in the related art cannot wash the dead corner of the inner tub. The spraying assembly 100 for the dish washing machine has a simple structure, a wide washing coverage, a good washing effect and a high user experience.

In other specific embodiments of the present disclosure, the gear ratio of the first sun gear 51 and the planetary gear 54 is 1:5. For example, the first sun gear 51 has 20 teeth, and the planetary gear 54 has 100 teeth. Thus, the ratio of the pitch radius R1 of the first sun gear 51 to the pitch radius R2 of the planetary gear 54 is 1:5 as well, and the radius R3 of the revolution trajectory of the planetary gear 54 is equal to the sum of R1 and R2. Furthermore, due to the gear ratio and the external engagement between the first sun gear 51 and the planetary gear 54, the ends of the respective spraying arms 31 each present the prolate epicycloid motion track, thus covering a square area better. Moreover, an angle of a phase difference between motion tracks of two spraying arms 31 is equal to 5/4 times of an angle of a phase difference between the two spraying arms 31.

For a single spraying arm 31, each spraying orifice 311 of the single spraying arm 31 has a characteristic epicycloid motion track. For the relatively outer spraying orifice 311, the distance from such spraying orifice 311 to the center of the planetary gear 54 is larger than six times of the pitch radius R2 of the planetary gear 54, the motion track of the spraying orifice 311 is a four-leaved prolate epicycloid. The curve does not cross itself, and four corners of the curve are curved outwards. With the position of the spraying orifice 311 moving inwards, the four inwards curved portions of the motion track gradually get obvious, the radius of the transition rounded corner is gradually reduced, and hence the corner gradually becomes sharp. When the distance from the spraying orifice 311 to the center of the planetary gear 54 is equal to six times of the pitch radius R2 of the planetary gear 54, i.e., five times of the revolution radius R3, the transition rounded corners at the four inwards curved portions are just disappeared and become into four pointed corners. Then, for the relatively inner spraying orifice 311, the distance from the spraying orifice 311 to the center of the planetary gear 54 is less than six times of the pitch radius R2 of the planetary gear 54, the inwards curved portion of the prolate epicycloid motion track defines has a crossed shape. Finally, for the spraying orifice 311 which is located at the center of the planetary gear 54, the motion track of such spraying orifice 311 is a revolution trajectory, i.e., a circle of radius R3.

During the operation of the spraying assembly 100 for the dish washing machine, the actuator 40 drives the spraying seat 20 to rotate around the central axis of the spraying seat 20. In this process, since the sprayer 30 is disposed in the eccentric position of the spraying seat 20, the sprayer 30 has a circular motion with respect to the spraying seat 20, and also has a motion with a changing rotation center with respect to the bottom shell 10. The washing water enters the water storage chamber 11 through the water inlet 12 of the bottom shell 10, then flows to each spraying arm 31 through the water input passage 21, and jets out of the plurality of spraying orifices 311, thus reaching the objective of dish washing, and also achieving a wide washing coverage.

Thus, the sprayer 30 is rotatably disposed in the eccentric position of the spraying seat 20 which is rotatable with respect to the bottom shell 10, and the gear ratio of the first sun gear 51 to the planetary gear 54 is set as 1:5, such that each spraying orifice 311 of the sprayer 30 has an epicycloid motion track, e.g., the spray-wash area is substantially square, thereby enlarging the washing area of the spraying assembly 100, solving the problem that the dish washing machine in the related art cannot wash the dead corner of the inner tub. The spraying assembly 100 for the dish washing machine has a simple structure, a wide washing coverage, a good washing effect and a high user experience.

Optionally, the driven transmission member is configured as a first gear 53 provided to the bottom shell 10, the first end of the drive shaft 52 is provided with a second sun gear 55 engaged with the first gear 53, the spraying seat 20 is provided with a second gear 56 engaged with the first gear 53, the second sun gear 55 cooperates with the first gear 53 and the second gear 56 to drive the spraying seat 20 to rotate.

Specifically, as illustrated in FIG. 2, the second sun gear 55 is fixedly provided to the lower end of the drive shaft 52, the bottom shell 10 is provided with the first gear 53 which is rotatable, and the lower end of the spraying seat 20 is provided with the second gear 56. The first gear 53 includes two toothed parts having different amounts of teeth and the two toothed parts are engaged with the second gear 56 and the second sun gear 55 correspondingly. When the spraying assembly 100 for the dish washing machine starts operating, the drive shaft 52 drives the first sun gear 51 and the second sun gear 55 to rotate around the central axis of the drive shaft 52. The second sun gear 55 on the drive shaft 52 is engaged with the first gear 53, such that the first gear 53 drives the spraying seat 20 to rotate around the central axis of the drive shaft 52 by the engagement with the second gear 56. The first sun gear 51 on the drive shaft 52 drives the sprayer 30 to rotate around the central axis of the planetary gear 54 by the engagement with the planetary gear 54. Thus, the spraying assembly 100 for the dish washing machine has a transmission system which is simple in structure, easy to dismount and mount, effortless to operate, low in cost and also can transmit motions accurately.

Figure 4:
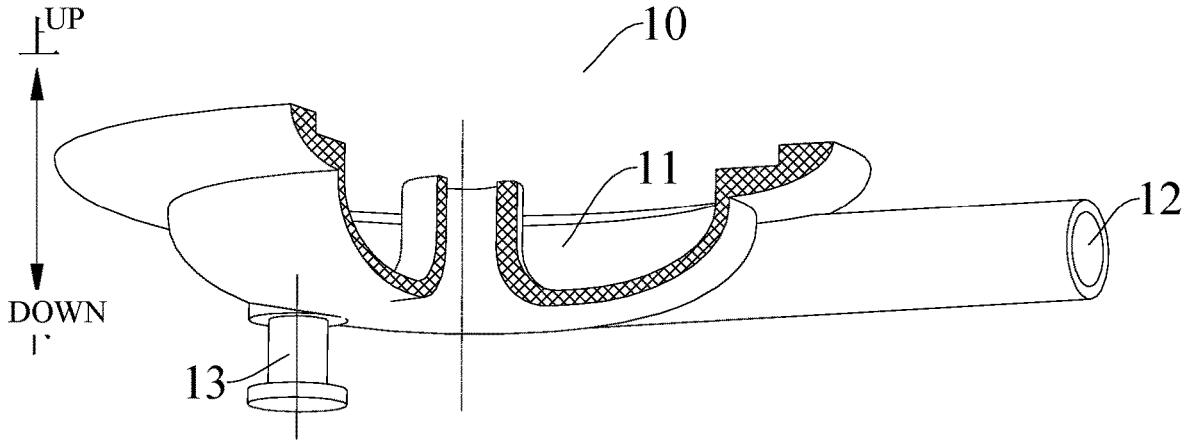
FIG. 4 is a schematic view of a bottom shell of a spraying assembly for a dish washing machine according to embodiments of the present disclosure.

Optionally, as illustrated in FIG. 4, a lower end of the bottom shell 10 is provided with a fixing shaft 13, the first gear 53 is mounted to the fixing shaft 13 and is rotatable with respect to the fixing shaft 13, thus facilitating the mounting of the first gear 53, and thereby achieving functional requirements of the spraying assembly 100 for the dish washing machine.

Figure 5:
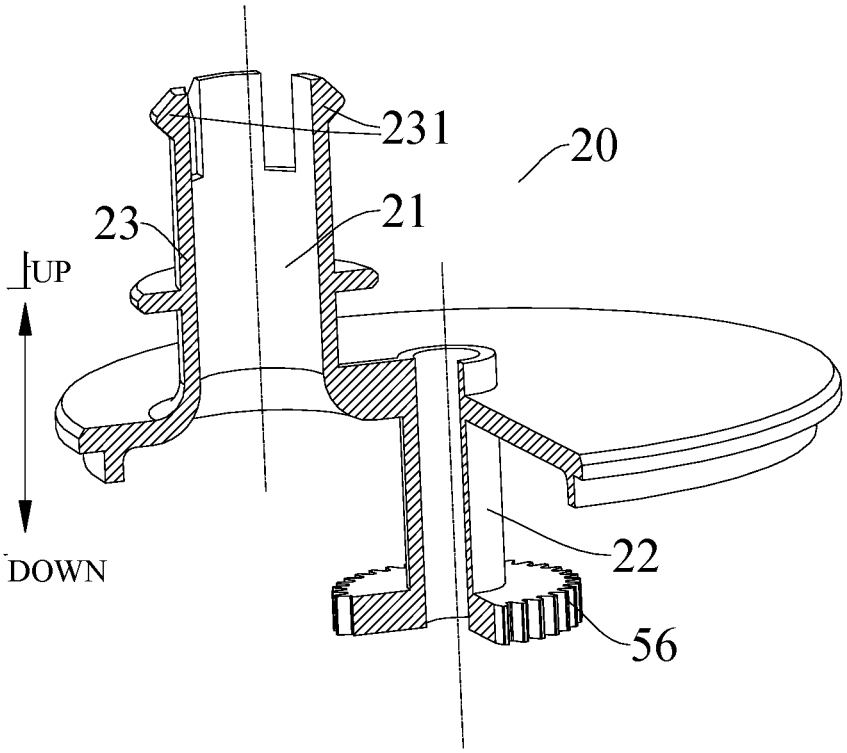
FIG. 5 is a schematic view of a spraying seat of a spraying assembly for a dish washing machine according to embodiments of the present disclosure.

As illustrated in FIG. 5, according to an embodiment of the present disclosure, the spraying seat 20 has a mounting portion 22 penetrating the bottom shell 10 and extending downwards, and the mounting portion 22 is configured as a hollow column coaxial with the drive shaft 52. The upper end of the drive shaft 52 passes through the mounting portion 22 to be connected to the first sun gear 51, and the lower end of the drive shaft 52 is provided with the second sun gear 55. The first gear 53 is disposed at a bottom portion of the bottom shell 10, and a lower end of the mounting portion 22 is provided with the second gear 56.

Specifically, the mounting portion 22 is located in the center of the spraying seat 20 and extends downwards in an axial direction (an up and down direction as illustrated in FIG. 5) of the spraying seat 20. The mounting portion 22 defines a cavity therein for mounting the drive shaft 52, and the drive shaft 52 penetrates the cavity and is rotatable with respect to the mounting portion 22. The upper and lower ends of the drive shaft 52 extend out of the cavity, so as to be provided with the first sun gear 51 and the second sun gear 55 correspondingly. The second sun gear 55 is engaged with the first gear 53 on the fixing shaft 13 of the bottom shell 10, and the first sun gear 51 is engaged with the planetary gear 54 of the sprayer 30.

Furthermore, the spraying seat 20 is provided with a mounting column 23 eccentrically provided with respect to a rotation center of the spraying seat 20, the mounting column 23 defines the water input passage 21 therein, and the sprayer 30 is fitted over the mounting column 23 and is rotatable with respect to the mounting column 23. Specifically, the sprayer 30 includes a sleeve 33 extending in the vertical direction, and the planetary gear 54 is provided at a lower end of the sleeve 33. When the sprayer 30 is mounted to the spraying seat 20, the spraying seat 20 serves as a planetary gear carrier for the planetary gear 54, so as to ensure the revolution trajectory of the planetary gear 54. At an upper end of the sleeve 33 of the sprayer 30, one or more spraying arms 31 extend outwards from the center of the planetary gear 54, and each spraying arm 31 is provided with a plurality of spraying orifices 311. Advantageously, a part of the spraying orifices 311 is used for washing, and other spraying orifices 311 are mostly used for forcing a horizontal rotation of the spraying arm 31 as well as the planetary gear 54, thereby providing power for the rotation of the sprayer 30.

Figure 6:
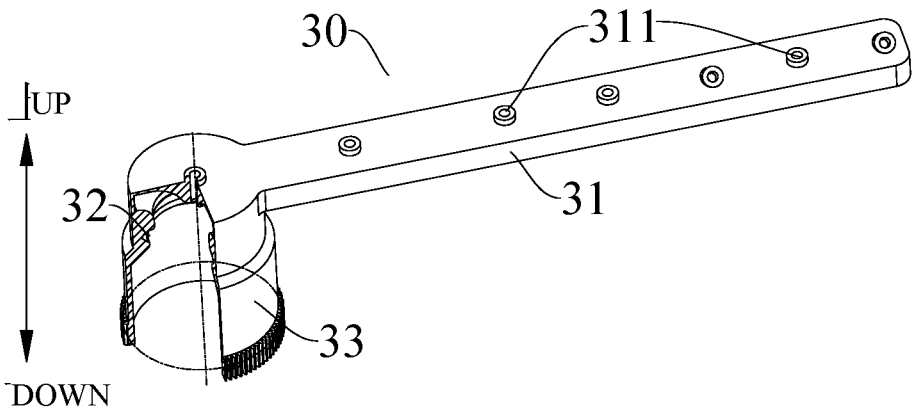
FIG. 6 is a schematic view of a sprayer of a spraying assembly for a dish washing machine according to embodiments of the present disclosure.

Optionally, as illustrated in FIGS. 5 and 6, the mounting column 23 is provided with a plurality of locking tongues 231 spaced apart, and an inner wall of the sprayer 30 is provided with a mounting groove 32 fitted with the locking tongues 231. Thus, it is ensured that the sprayer 30 can be snapped with the spraying seat 20, so as to avoid the sprayer 30 from being disengaged with the spraying seat 20 during operations, and also, the relative rotation between the sprayer 30 and the spraying seat 20 is ensured, such that rotations of the sprayer 30 and the planetary gear 54 can be achieved.

Figure 7:
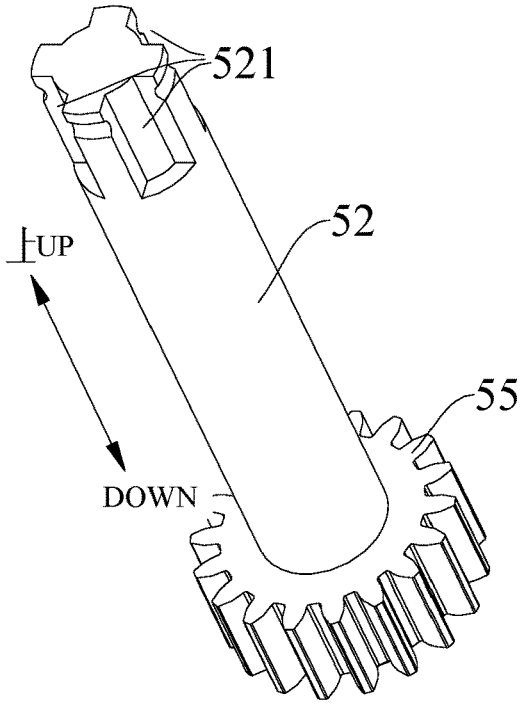
FIG. 7 is an assembly view of a drive shaft and a second sun gear of a spraying assembly for a dish washing machine according to embodiments of the present disclosure.
Figure 8:
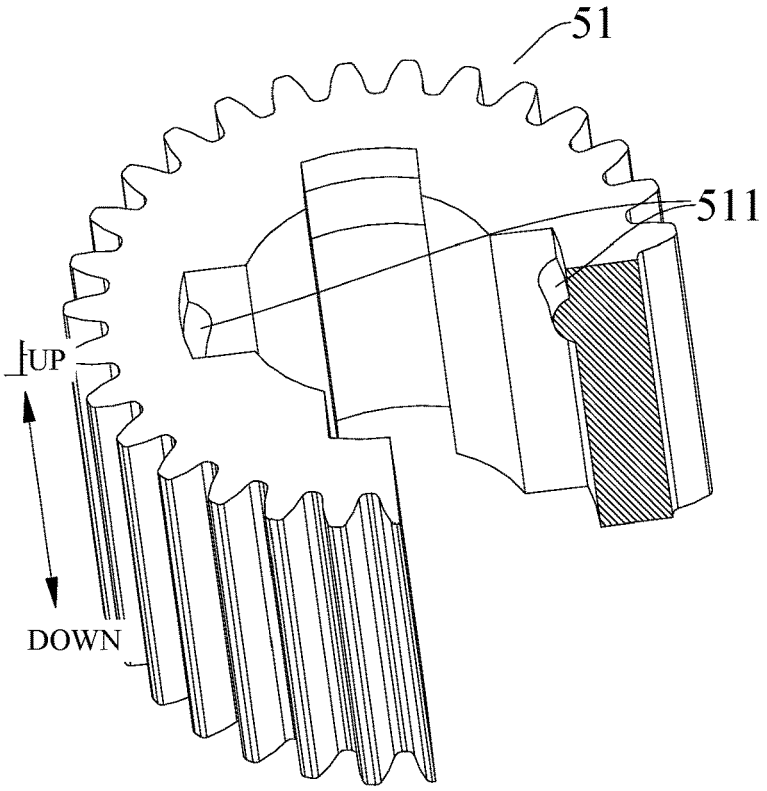
FIG. 8 is schematic view of a first sun gear of a spraying assembly for a dish washing machine according to embodiments of the present disclosure.

According to an embodiment of the present disclosure, the upper end of the drive shaft 52 is provided with a plurality of grooves 521 spaced apart, and an inner ring of the first sun gear 51 is provided with a plurality of bulges 511 correspondingly fitted with the grooves 521. Specifically, as illustrated in FIG. 7, a side wall of the upper end of the drive shaft 52 is provided with the plurality of grooves 521 spaced apart in its circumferential direction, and an inner wall of the first sun gear 51 is provided with the plurality of bulges 511 correspondingly fitted with the grooves 521, thus ensuring the first sun gear 51 to be fixedly connected to the drive shaft 52, and hence improving the connection reliability of the spraying assembly 100 for the dish washing machine.

In some specific embodiments of the present disclosure, the end of the drive shaft 52 which is fitted with the first sun gear 51 is configured as a spline shaft, and the spline shaft is snapped with the first sun gear 51.

Specifically, an inner wall of the first sun gear 51 is provided with a splined hole, and four bulges 511 are provided in the splined hole. When mounted, the first sun gear 51 is sleeved onto the spline shaft of the drive shaft 52, till the four bulges 511 are correspondingly locked in four grooves 521 of the spline shaft, thereby achieving the fixation of the first sun gear 51. Such connection structure can achieve the fit between the drive shaft 52 and the first sun gear 51, and is simple in structure, easy to produce and high in efficiency of mounting and dismounting.

Preferably, according to an embodiment of the present disclosure, the spraying seat 20 is a rotary body, and a central axis of the spraying seat 20 coincides with the central axes of the bottom shell 10 and the drive shaft 52. In addition, the spraying assembly 100 for the dish washing machine further includes a pressing plate 60, the pressing plate 60 is provided on the bottom shell 10 and is connected to the bottom shell 10, and at least a part of the pressing plate 60 is pressed on the spraying seat 20.

Specifically, as illustrated in FIG. 2, the spraying seat 20 is located between the first sun gear 51 and the bottom shell 10, the central axes of the spraying seat 20, the first sun gear 51 and the bottom shell 10 coincide with one another, and a main body of the spraying seat 20 is a round rotary disk. When mounted, the water storage chamber 11 of the bottom shell 10 is covered by the spraying seat 20 first, and the mounting portion 22 of the spraying seat 20 extends into the water storage chamber 11. Then, an outer ring of the spraying seat 20 is pressed by the pressing plate 60. At this time, the drive shaft 52 is inserted into the mounting portion 22 and extends out of the spraying seat 20, and then the first sun gear 51 is fitted with the upper end of the drive shaft 52. Finally, the sprayer 30 is mounted to the mounting column 23 of the spraying seat 20, and the planetary gear 54 on the sprayer 30 is engaged with the first sun gear 51 on the drive shaft 52. Therefore, the spraying seat 20 is embedded between the pressing plate 60 and the bottom shell 10, and can rotate with respect to the pressing plate 60 and the bottom shell 10.

Preferably, according to an embodiment, the second sun gear 55 is integrally formed with the drive shaft 52, the planetary gear 54 is integrally formed with the sprayer 30, and the second gear 56 is integrally formed with the spraying seat 20. Thus, an integrally formed structure ensures stability of the structure and property of the spraying assembly 100 for the dish washing machine, is convenient to mold and easy to produce, and also omits needless assembly parts and connecting processes, thus greatly improving the assembly efficiency of the spraying assembly 100 for the dish washing machine, and ensuring the connection reliability of the spraying assembly 100 for the dish washing machine. Moreover, the integrally formed structure has high overall strength and stability, is easy to assemble and provides a long service life.

The spraying assembly 100 for the dish washing machine according to embodiments of the present disclosure will be described with reference to specific embodiments illustrated in FIGS. 1-15.

Embodiment One

As illustrated in FIGS. 1-9, in the present embodiment, the first sun gear 51 is fixed in a center position at the bottom of the inner tub of the dish washing machine, the inner wall of the first sun gear 51 is provided with the splined hole, and the four bulges 511 are provided in the splined hole defines. When mounted, the first sun gear 51 is sleeved onto the spline shaft of the drive shaft 52, till the four bulges 511 are correspondingly locked in four grooves 521 of the spline shaft, thereby achieving the fixed connection of the first sun gear 51 with the drive shaft 52. The water storage chamber 11 in the bottom shell 10 is an annular flow channel, and the side wall of the bottom shell 10 is provided with the water inlet 12, such that the washing water enters the water storage chamber 11 in the substantially tangential direction, then flows along the annular flow channel to fill the whole water storage chamber 11, finally flows out of the water input passage 21 of the spraying seat 20, and flows to the spraying arm 31.

Figure 9:
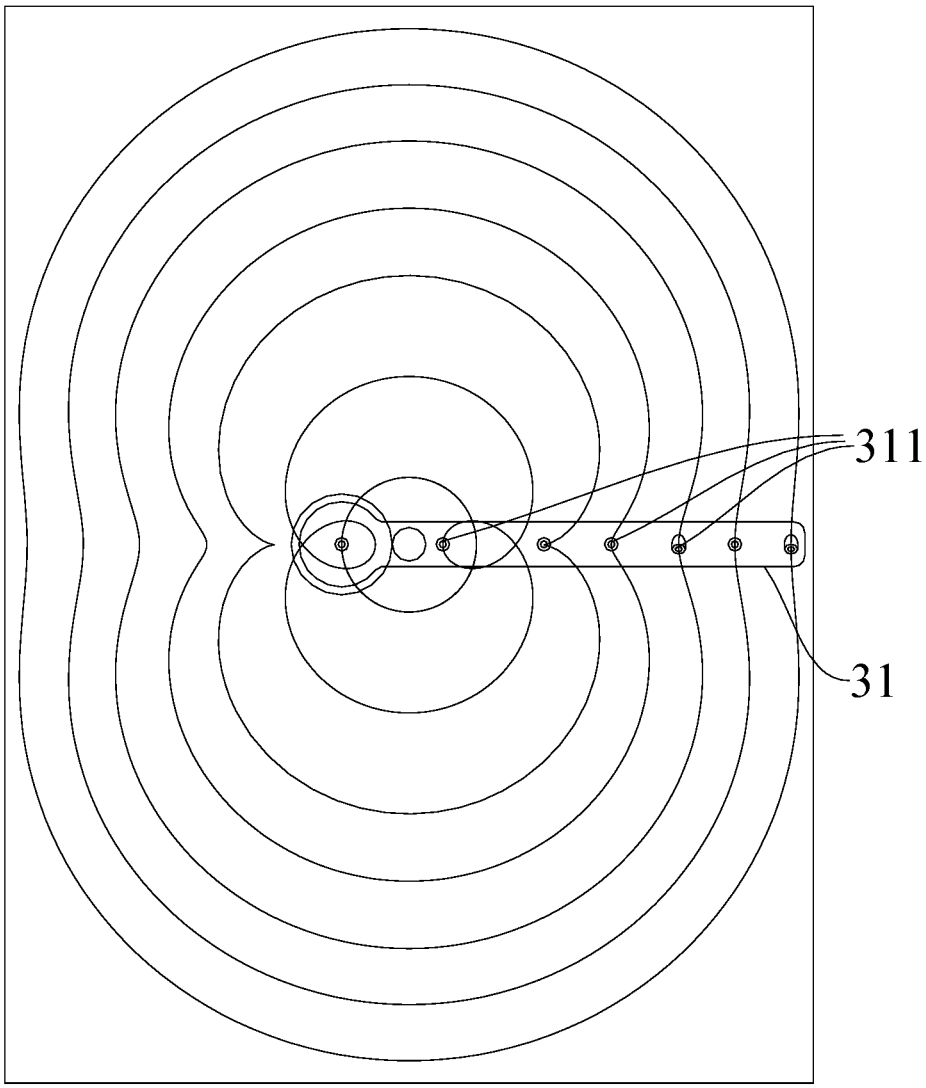
FIG. 9 illustrates motion tracks of respective spraying orifices of a spraying assembly for a dish washing machine according to an embodiment of the present disclosure.

As illustrated in FIG. 9, in the present embodiment, the gear ratio of the first sun gear 51 to the planetary gear 54 is 1:3, in which the spraying assembly 100 for the dish washing machine includes one spraying arm 31. According to the gear ratio and the external engagement between the first sun gear 51 and the planetary gear 54, the end of the spraying arm 31 presents the prolate epicycloid motion track which is substantially rectangle, thus achieving a great coverage of a rectangle spraying area. Specifically, a curvilinear equation of the prolate epicycloid motion track includes:

$$x=(R1+R2)*\cos(\text{ang})-D*\cos[(R1*\text{ang}/R2]$$

$$y=-(R1+R2)*\sin(\text{ang})+D*\sin[(R1*\text{ang}/R2].$$

D denotes a distance between the spraying orifice 311 and the center of the planetary gear 54, R1 denotes a pitch radius of the first sun gear 51, and R2 denotes a pitch radius of the planetary gear 54.

For example, modules of the first sun gear 51 and the planetary gear 54 are set as 0.5, the first sun gear 51 has 30 teeth, and the planetary gear 54 has 90 teeth. It can be seen that, a ratio of the pitch radius R1 of the first sun gear 51 to the pitch radius R2 of the planetary gear 54 is also 1:3. Specifically, R1 is equal to 7.5 mm, R2 is equal to 22.5 mm, and a radius R3 of a revolution trajectory of the planetary gear 54 is equal to a sum of R1 and R2, i.e. 30 mm.

Furthermore, the distance from the relatively outer spraying orifice 311 in the spraying arm 31 to the center of the planetary gear 54 is larger than four times of the pitch radius R2 of the planetary gear 54, i.e. 90 mm, and the motion track of such spraying orifice 311 is the prolate epicycloid. The curve does not cross itself, front and rear parts of the curve are curved outwards, and left and right parts of the curve are slightly curved inwards. With the position of the spraying orifice 311 moving inwards, the inwards curved portion of the prolate epicycloid motion track gradually gets obvious, a radius of a transition rounded corner is gradually reduced, and four corners gradually become sharp. When the distance from the spraying orifice 311 to the center of the planetary gear 54 is equal to 90 mm, the transition rounded corner at the inwards curved portion is just disappeared, the overall prolate epicycloid motion track of the spraying orifice 311 is a kidney-shaped curve with the front and rear parts thereof being curved outwards. Then, for the relatively inner spraying orifice 311, the distance from such spraying orifice 311 to the center of the planetary gear 54 is less than 90 mm, and the inwards curved portion of the prolate epicycloid motion track has a crossed shape. Finally, for the spraying orifice 311 which is located in the center of the planetary gear 54, the motion track of such spraying orifice 311 is the revolution trajectory, i.e., a circle of radius 30 mm.

When the spraying assembly 100 for the dish washing machine operates, due to a recoiling action of water spraying by a part of the spraying orifices 311 in the spraying arm, the spraying arm 31 along with the planetary gear 54 are driven to rotate. Due to the gear engagement, the spraying arm 31 along with the planetary gear 54 orbit the first sun gear 51 while rotating. The rotation and the revolution have the same direction, and a rotation speed ratio of the rotation to the revolution is 1:3.

Embodiment Two

Figure 10:
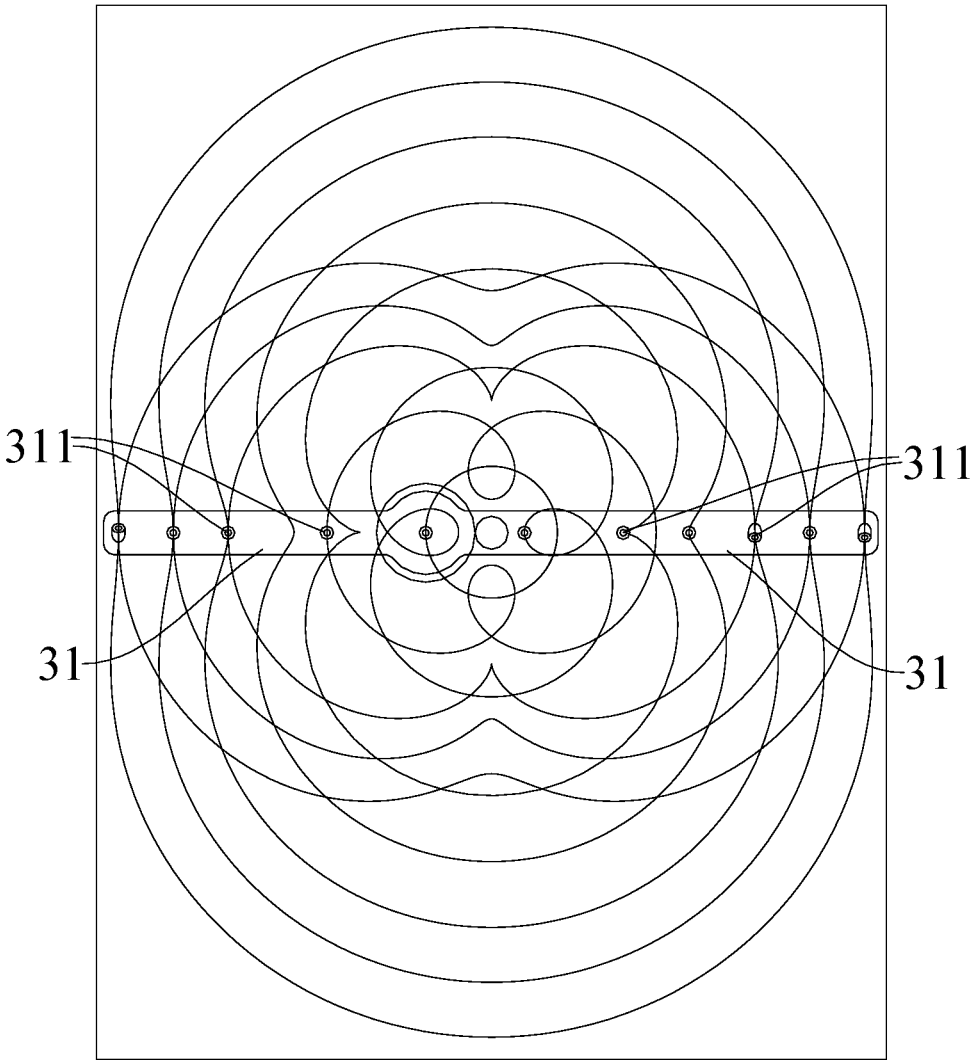
FIG. 10 illustrates motion tracks of respective spraying orifices of a spraying assembly for a dish washing machine according to another embodiment of the present disclosure.

As illustrated in FIG. 10, in the present embodiment, the gear ratio of the first sun gear 51 to the planetary gear 54 is 1:3, and the sprayer 30 has two spraying arms 31. That is, two spraying arms 31 extend outwards from the center of the planetary gear 54, and the two spraying arms 31 are diagonally arranged with a phase difference of 180° therebetween. The two spraying arms 31 each are provided with a group of spraying orifices 311. According to the gear ratio 1:3 and the external engagement between the first sun gear 51 and the planetary gear 54, motion tracks of two spraying arms 31 have a phase difference, which is equal to 3/2 times of the phase difference between the two spraying arms 31, and specifically is 270°. That is, the two motion tracks are perpendicular to each other.

The spraying orifices 311 in the two spraying arms 31 have a characteristic prolate epicycloid motion track respectively, whose features are consistent with descriptions of Embodiment One, and will not be elaborated herein. Moreover, since the motion tracks of the two groups of spraying orifices 311 in the two spraying arms 31 has the phase difference of 270°, the two groups of motion tracks are crossed while being perpendicular to each other, thus obtaining a great washing coverage effect within the rectangle central area.

Embodiment Three

Figure 11:
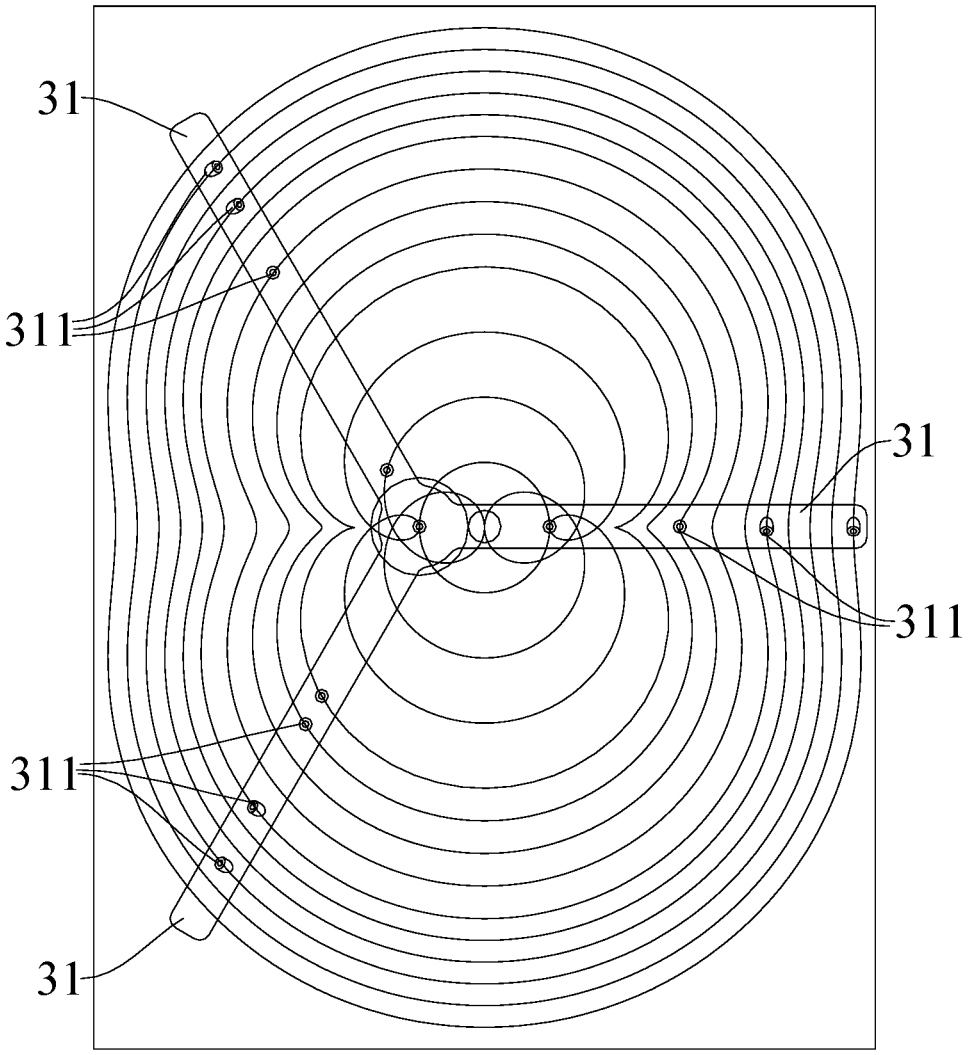
FIG. 11 illustrates motion tracks of respective spraying orifices of a spraying assembly for a dish washing machine according to a further embodiment of the present disclosure.

As illustrated in FIG. 11, in the present embodiment, the gear ratio of the first sun gear 51 is the planetary gear 54 is 1:3, and the sprayer 30 has three spraying arms 31, that is, three spraying arms 31 extend outwards from the center of the planetary gear 54. Each two of the three spraying arms 31 are spaced apart from each other by an interval of 120°. Each spraying arm 31 is provided with a group of spraying orifices 311. According to the gear ratio 1:3 and the external engagement between the first sun gear 51 and the planetary gear 54, motion tracks of three spraying arms 31 have a phase difference, which is equal to 3/2 times of a phase difference between the three spraying arms 31, i.e., 180° and 360°.

Each group of spraying orifices 311 in the three spraying arms 31 has a characteristic prolate epicycloid motion track, whose features are consistent with the descriptions of Embodiment One, and will not be elaborated herein. Moreover, since the motion tracks of the three groups of spraying orifices 311 have the phase difference of 180° or 360°, the three motion tracks have a same orientation, and are superimposed to form denser motion tracks of the spraying orifices 311, thus achieve a better washing coverage effect within the rectangle spraying area.

Thus, the spraying assembly 100 for the dish washing machine can achieve a great washing coverage effect by adjusting the amount of the spraying arms 31 and the amount of the spraying orifices 311, such that it is ensured the rectangle spraying area of the spraying assembly 100 for the dish washing machine is matched with the rectangle inner tub of the dish washing machine, thereby ensuring an all-around and multi-angle cleaning rate.

Embodiment Four

Figure 12:
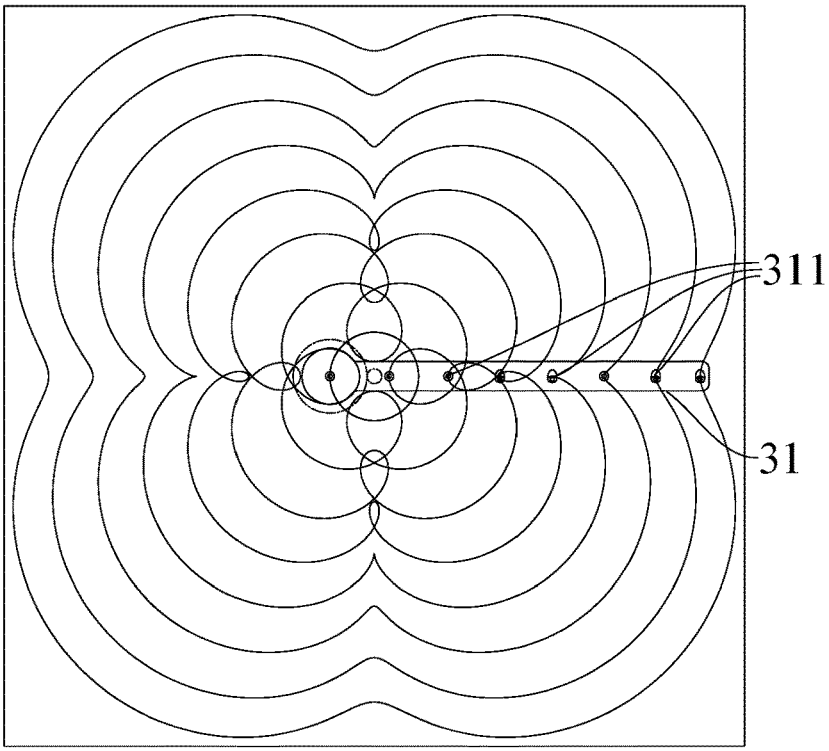
FIG. 12 illustrates motion tracks of respective spraying orifices of a spraying assembly for a dish washing machine according to an embodiment of the present disclosure.

As illustrated in FIG. 12, in the present embodiment, the gear ratio of the first sun gear 51 to the planetary gear 54 is 1:5, and the spraying assembly 100 for the dish washing machine includes one spraying arm 31. According to the gear ratio and the external engagement between the first sun gear 51 and the planetary gear 54, the end of the spraying arm 31 presents a prolate epicycloid motion track which is substantially square, thus achieving a great coverage of a square spraying area. Specifically, a curvilinear equation of the prolate epicycloid motion track includes:

$$x=(R1+R2)*\cos(\text{ang})-D*\cos[(R1*\text{ang}/R2]$$

$$y=-(R1+R2)*\sin(\text{ang})+D*\sin[(R1*\text{ang}/R2].$$

D denotes a distance from the spraying orifice 311 to the center of the planetary gear 54, R1 denotes a pitch radius of the first sun gear 51, and R2 denotes a pitch radius of the planetary gear 54.

For example, modules of the first sun gear 51 and the planetary gear 54 both are 0.5, the first sun gear 51 has 20 teeth, and the planetary gear 54 has 100 teeth. It can be seen that, a ratio of the pitch radius R1 of the first sun gear 51 to the pitch radius R2 of the planetary gear 54 is also 1:5. Specifically, R1 is equal to 5 mm, R2 is equal to 25 mm, and a radius R3 of a revolution trajectory of the planetary gear 54 is equal to a sum of R1 and R2, i.e. 30 mm.

Furthermore, according to the gear ratio 1:5 and the external engagement between the first sun gear 51 and the planetary gear 54, as well as a rotation speed ratio 5:1 of the first sun gear 51 to the spraying seat 20 achieved by a speed-setting gear train mechanism, it can be seen that, a rotation speed of the planetary gear 54 is ⅕ of a rotation speed of the spraying seat 20. That is, it is can be further seen that the spraying orifice 311 in the spraying arm 31 presents a special prolate epicycloid motion track. For the relatively outer spraying orifice 311, a distance from such spraying orifice 311 to the center of the planetary gear 54 is larger than six times (i.e., 150 mm) of the pitch radius R2 of the planetary gear 54, and the motion track of such spraying orifice 311 is a four-leaved prolate epicycloid. The curve does not cross itself, and four corners of the curve are curved outwards. With the position of the spraying orifice 311 moving inwards, four inwards curved portions of the motion track gradually get obvious, a radius of the transition rounded corner is gradually reduced, and hence the corner gradually becomes sharp. When the distance from the spraying orifice 311 to the center of the planetary gear 54 is equal to 150 mm, i.e., five times of a revolution radius R3, the transition rounded corners at the four inwards curved portions are just disappeared and become into four pointed corners. Then, for the relatively inner spraying orifice 311, the distance from such spraying orifice 311 to the center of the planetary gear 54 is less than 150 mm, and the prolate epicycloid motion track of such spraying orifice 311 has a crossed shape at the inwards curved portion. Finally, for the spraying orifice 311 located in the center of the planetary gear 54, the motion track of such spraying orifice 311 is a revolution trajectory, i.e., a circle of radius 30 mm.

When the spraying assembly 100 for the dish washing machine operates, due to a recoiling action of water spraying by a part of the spraying orifices 311 in the spraying arm 31, the spraying arm 31 along with the planetary gear 54 are driven to rotate. Due to the gear engagement, the spraying arm 31 along with the planetary gear 54 orbit the first sun gear 51 while rotating. The rotation and the revolution have the same direction, and a rotation speed ratio of the rotation to the revolution is 1:5.

Embodiment Five

Figure 13:
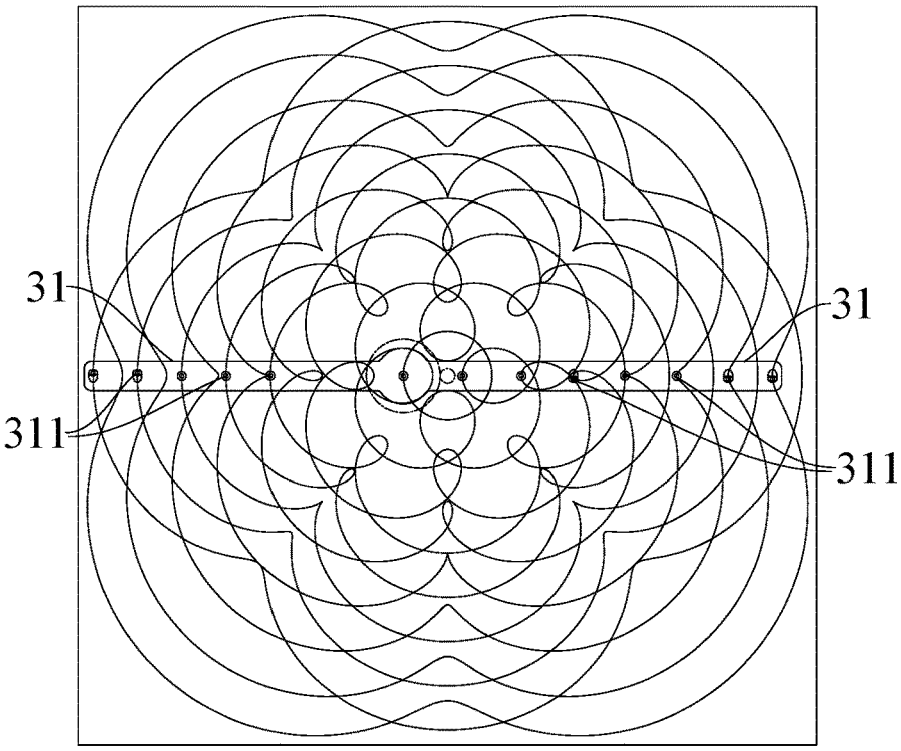
FIG. 13 illustrates motion tracks of respective spraying orifices of a spraying assembly for a dish washing machine according to a further embodiment of the present disclosure.

As illustrated in FIG. 13, in the present embodiment, the gear ratio of the first sun gear 51 to the planetary gear 54 is 1:5, and the sprayer 30 has two spraying arms 31. That is, two spraying arms 31 extend outwards from the center of the planetary gear 54, and the two spraying arms 31 are diagonally arranged with a phase difference of 180° therebetween. The two spraying arms 31 each are provided with a group of spraying orifices 311. According to the gear ratio 1:5 and the external engagement between the first sun gear 51 and the planetary gear 54, motion tracks of the two spraying arms 31 have a phase difference, which is equal to 5/4 times of a phase difference between the two spraying arms 31, and specifically is 225°. In this case, the inwards curved portion in the motion track of one of the spraying arms 31 is corresponding to the outwards curved portion in the motion track of the other one of the spraying arms 31.

The spraying orifices 311 in the two spraying arms 31 have the characteristic prolate epicycloid motion tracks respectively, whose features are consistent with the descriptions of Embodiment Four, and will not be elaborated herein. Moreover, since the motion tracks of the two groups of spraying orifices 311 in the two spraying arms 31 has the phase difference of 225°, the two motion tracks are interwoven into a net in a central spraying area, thus reaching a great washing coverage effect.

Embodiment Six

Figure 14:
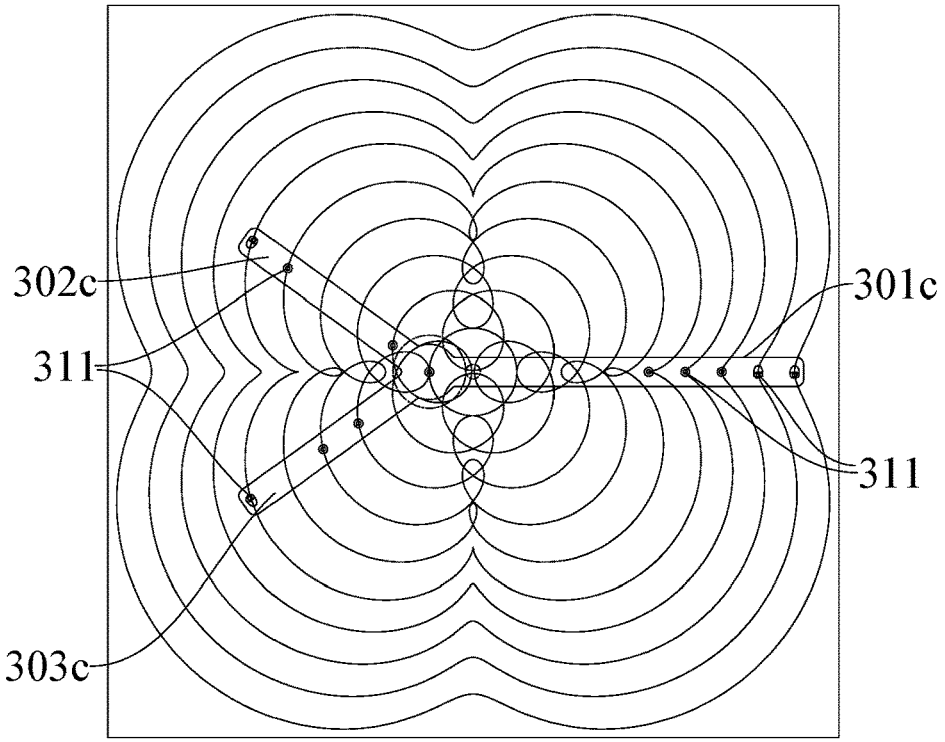
FIG. 14 illustrates motion tracks of respective spraying orifices of a spraying assembly for a dish washing machine according to another embodiment of the present disclosure.

As illustrated in FIG. 14, in the present embodiment, the gear ratio of the first sun gear 51 to the planetary gear 54 is 1:5, and the sprayer 30 has three spraying arms 31. That is, three spraying arms 31 extend outwards from a center of the planetary gear 54. A first spraying arm 301*c* is spaced apart from a second spraying arm 302*c* by an angle of 144°, and the first spraying arm 301*c* is spaced apart from a third spraying arm 303*c* by an angle of 144°. That is, an included angle between the second spraying arm 302*c* and the third spraying arm 303*c* is 72°. Lengths of the second spraying arm 302*c* and the third spraying arm 303*c* are about 0.618 times of a length of the first spraying arm 301*c*, thereby ensuring a balance of the overall sprayer 30. Each spraying arm 31 is provided with a group of spraying orifices 311. Three motion tracks of the first spraying arm 301*c*, the second spraying arm 302*c* and the third spraying arm 303*c* have phase differences therebetween, which are equal to 5/4 times of the phase differences of 72° and 144° among the spraying arms 31, i.e., 90° and 180°, and therefore the three motion tracks have the same shape and orientation.

Each group of spraying orifices 311 in the three spraying arms 31 has a characteristic prolate epicycloid motion track, whose features are consistent with the descriptions of Embodiment Four, and will not be elaborated herein. Moreover, since the phase differences among the motion tracks of the three groups of spraying orifices 311 are 90° and 180° correspondingly, the three motion tracks have the same shape and orientation, and are superimposed to form dense motion tracks of the spraying orifices 311, thus achieving a great washing coverage effect in a square spraying area.

Embodiment Seven

Figure 15:
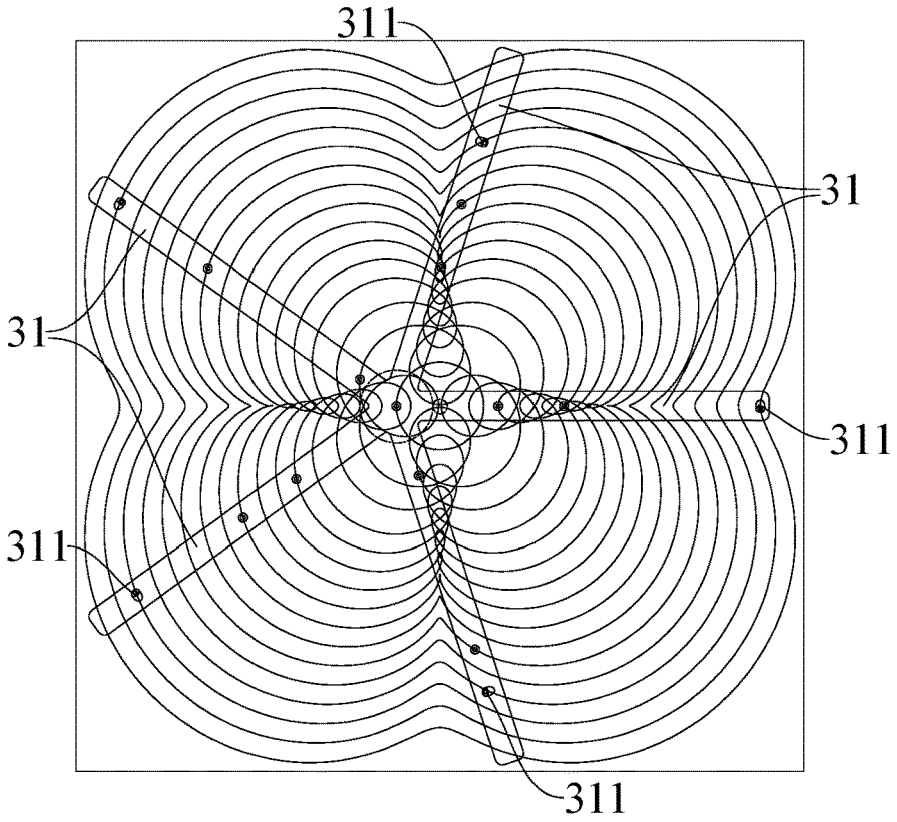
FIG. 15 illustrates motion tracks of respective spraying orifices of a spraying assembly for a dish washing machine according to a further embodiment of the present disclosure.

As illustrated in FIG. 15, in the present embodiment, the gear ratio of the first sun gear 51 to the planetary gear 54 is 1:5, and the sprayer 30 has five spraying arms 31. That is, five spraying arms 31 extend outwards from a center of the planetary gear 54. Two adjacent spraying arms 31 are spaced apart from each other by an angle of 72°. Each spraying arm 31 is provided with a group of spraying orifices 311. According to the gear ratio 1:5 and the external engagement between the first sun gear 51 and the planetary gear 54, motion tracks of the five spraying arms 31 have phase differences therebetween, which are equal to 5/4 times of the phase differences of 72° among the three spraying arms 31, i.e., 90°, and therefore the five motion tracks have the same shape and orientation.

Each group of spraying orifices 311 in the five spraying arms 31 has a characteristic prolate epicycloid motion track, whose features are consistent with the descriptions of Embodiment Four, and will not be elaborated herein. Moreover, since the motion tracks of the five groups of spraying orifices 311 have the phase differences of 90°, the five motion tracks have the same shape and orientation, and finally are superimposed to form dense motion tracks of the spraying orifices 311, thus achieving a great washing coverage effect in a square spraying area.

Thus, the spraying assembly 100 for the dish washing machine can achieve a better washing coverage effect by adjusting the amount of the spraying arms 31 and the amount of the spraying orifices 311, so as to ensure that the square spraying area of the spraying assembly 100 for the dish washing machine is matched with the square inner tub of the dish washing machine, thereby achieving an all-around and multi-angle cleaning rate.

A dish washing machine according to embodiments of a second aspect of the present disclosure includes the spraying assembly 100 for the dish washing machine according to the above-mentioned embodiments. Since the spraying assembly 100 for the dish washing machine according to embodiments of the present disclosure has the above-mentioned technical effects, the dish washing machine according to embodiments of the present disclosure has the above-mentioned effects as well. That is, the dish washing machine has a simple structure and a wide washing coverage, and provides a quadrate (such as square and rectangle) spraying area matched with a quadrate inner tub of the dish washing machine, thereby solving the problem that the dish washing machine in the related art cannot wash a dead corner of the inner tub. Thus, the dish washing machine has a great washing effect and a high user experience.

Other components and operations of the dish washing machine according to embodiments of the present disclosure are known to those skilled in the art, and will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as illustrated in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been illustrated and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A spraying assembly for a dish washing machine, comprising:

a bottom shell, the bottom shell defining a water storage chamber therein, and having a water inlet in communication with the water storage chamber;

a spraying seat, the spraying seat being rotatably disposed on the bottom shell, and having a water input passage in communication with the water storage chamber;

a sprayer, the sprayer having at least one spraying arm, the sprayer being rotatably disposed on the spraying seat and a rotation center of the sprayer being eccentrically provided with respect to a rotation center of the spraying seat, the sprayer having a plurality of spraying orifices spaced apart, each spraying orifice being in communication with the water input passage respectively, and the sprayer is provided with a planetary gear engaged with a first sun gear connected to a drive shaft rotatably disposed on the spraying seat; and an actuator, the actuator being connected to the sprayer and the spraying seat respectively, so as to drive the sprayer and the spraying seat to rotate around their respective rotation centers.

2. The spraying assembly for the dish washing machine according to claim 1, further comprising:

a driving transmission member, the driving transmission member being connected to the actuator and the sprayer, and being driven by the actuator to drive the sprayer to rotate; and a driven transmission member, the driven transmission member being connected to the driving transmission member and the spraying seat, and being driven by the driving transmission member to drive the spraying seat to rotate.

3. The spraying assembly for the dish washing machine according to claim 2, wherein a first end of the drive shaft is connected to the actuator, the first sun gear is connected to a second end of the drive shaft, and the first sun gear is coaxial with the drive shaft and is driven by the drive shaft.

4. The spraying assembly for the dish washing machine according to claim 3, wherein a gear ratio of the first sun gear to the planetary gear is 1:3.

5. The spraying assembly for the dish washing machine according to claim 3, wherein a gear ratio of the first sun gear to the planetary gear is 1:5.

6. The spraying assembly for the dish washing machine according to claim 3, wherein the driven transmission member is configured as a first gear disposed on the bottom shell, the first end of the drive shaft is provided with a second sun gear engaged with the first gear, the spraying seat is provided with a second gear engaged with the first gear, and the second sun gear cooperates with the first gear and the second gear to drive the spraying seat to rotate.

7. The spraying assembly for the dish washing machine according to claim 6, wherein the spraying seat has a mounting portion penetrating the bottom shell and extending downwards, the mounting portion is configured as a hollow column coaxial with the drive shaft, an upper end of the drive shaft passes through the mounting portion to be connected to the first sun gear, a lower end of the drive shaft is provided with the second sun gear, the first gear is disposed at a bottom portion of the bottom shell, and a lower end of the mounting portion is provided with the second gear.

8. The spraying assembly for the dish washing machine according to claim 7, wherein the upper end of the drive shaft is provided with a plurality of grooves spaced apart, and an inner ring of the first sun gear is provided with a plurality of bulges correspondingly fitted with the grooves.

9. The spraying assembly for the dish washing machine according to claim 6, wherein the end of the drive shaft, which is fitted with the first sun gear, is configured as a spline shaft, and the spline shaft is snapped with the first sun gear.

10. The spraying assembly for the dish washing machine according to claim 6, wherein the spraying seat is a rotary body, and a central axis of the spraying seat coincides with central axes of the bottom shell and the drive shaft.

11. The spraying assembly for the dish washing machine according to claim 10, wherein the spraying seat is provided with a mounting column eccentrically arranged with respect to the rotation center of the spraying seat, the mounting column defines the water input passage therein, the sprayer is fitted over the mounting column and is rotatable with respect to the mounting column.

12. The spraying assembly for the dish washing machine according to claim 11, wherein the mounting column is provided with a plurality of locking tongues spaced apart, and an inner wall of the sprayer is provided with a mounting groove fitted with the locking tongues.

13. The spraying assembly for the dish washing machine according to claim 6, further comprising a pressing plate, the pressing plate being provided on the bottom shell and being connected to the bottom shell, and at least a part of the pressing plate being pressed on the spraying seat.

14. The spraying assembly for the dish washing machine according to claim 7, wherein the second sun gear is integrally formed with the drive shaft, the planetary gear is integrally formed with the sprayer, and the second gear is integrally formed with the spraying seat.

15. A dish washing machine, comprising a spraying assembly according to claim 1.

* * * * *